US006465958B1

(12) United States Patent
Wilcox et al.

(10) Patent No.: US 6,465,958 B1
(45) Date of Patent: Oct. 15, 2002

(54) ELECTRON BEAM TUBES

(75) Inventors: David Mark Wilcox; Darrin Bowler, both of Essex (GB)

(73) Assignee: EEV Limited, Essex (GB)

( * ) Notice: Subject to any disclaimer, the term of this patent is extended or adjusted under 35 U.S.C. 154(b) by 0 days.

(21) Appl. No.: 09/555,012

(22) PCT Filed: Nov. 27, 1998

(86) PCT No.: PCT/GB98/03568

§ 371 (c)(1),
(2), (4) Date: Jul. 24, 2000

(87) PCT Pub. No.: WO99/28943

PCT Pub. Date: Jun. 10, 1999

(30) Foreign Application Priority Data

Nov. 27, 1997 (GB) ..... 9724960

(51) Int. Cl.[7] ..... H01J 25/10

(52) U.S. Cl. ..... 315/5.43; 315/5.51; 315/5.52; 315/5.39

(58) Field of Search ..... 315/3.6, 5.36, 315/5.43, 5.14, 5.15, 5.35, 5.37, 5.51; 333/227; 330/43

(56) References Cited

U.S. PATENT DOCUMENTS 2,579,480 A * 12/1951 Feenberg ..... 315/5.43
3,614,516 A * 10/1971 Phillips ..... 315/5.35
3,811,065 A * 5/1974 Lien ..... 315/5.43
4,004,181 A 1/1977 Kervizic et al. ..... 315/5.41
4,398,122 A * 8/1983 Gosset ..... 315/5.38
4,431,944 A * 2/1984 Deville et al. ..... 315/3.6
5,821,693 A * 10/1998 White et al. ..... 315/5.43

FOREIGN PATENT DOCUMENTS

| | | | |
|---|---|---|---|
| EP | 0082769 | 6/1983 | ..... H01J/25/02 |
| EP | 0352961 | 1/1990 | ..... H01J/25/10 |
| GB | 924865 | * 5/1963 | |
| GB | 1208700 | * 10/1970 | |
| GB | 1351798 | * 5/1974 | |
| GB | 2292001 | * 2/1996 | |

* cited by examiner

*Primary Examiner*—Don Wong
*Assistant Examiner*—Jimmy T. Vu
(74) *Attorney, Agent, or Firm*—Donald C. Casey, Esq.

(57) ABSTRACT

An electron beam tube such as a klystron includes a penultimate resonant cavity (22) located before the output cavity (14). The penultimate resonant cavity (22) is arranged to be inductively coupled, being resonant at a frequency which is slightly greater than a harmonic frequency. This provides increased sharpening of bunches of electrons arriving at the output cavity (14) giving increased efficiency at the output.

14 Claims, 3 Drawing Sheets

ELECTRON BEAM TUBES

This invention relates to electron beam tubes of a type wherein an input signal having a fundamental frequency is applied to an electron beam to form electron bunches.

Figure 1:
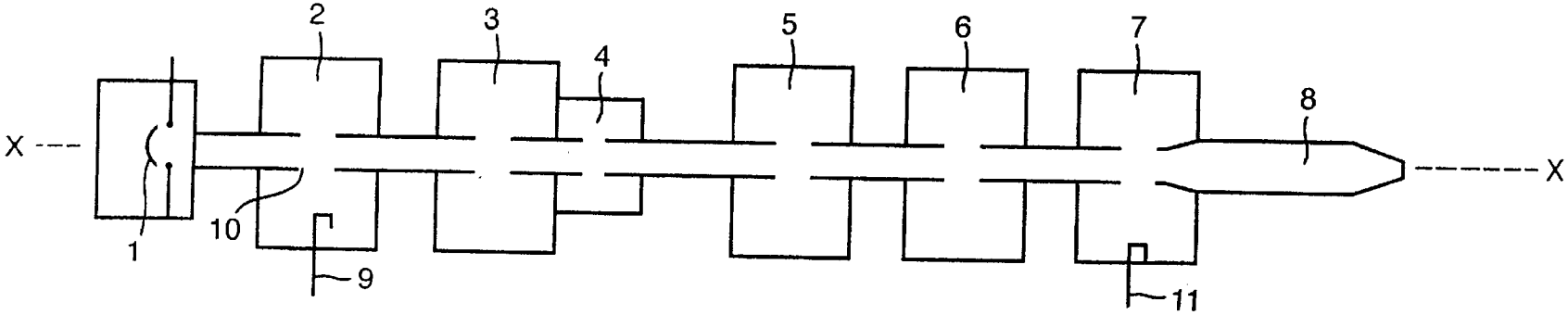
Fig.1. (PRIOR ART)

A klystron is a well known device in which velocity modulation of an electron beam is achieved following interaction with an applied high frequency input signal and a series of resonant cavities. FIG. 1 schematically illustrates a prior art klystron having an electron gun 1, an input resonant cavity 2, four intermediate cavities 3, 4, 5 and 6 and an output resonant cavity 7 followed by an electron beam collector 8. During operation, an electron beam is generated by the electron gun 1 along the axis X—X of the klystron. A high frequency input signal, described as the fundamental frequency, is coupled into the input cavity 2 via a coupling loop 9 or other coupling means and causes an electric field to be produced across a drift tube gap 10 in the input cavity 2. This acts on the electrons arriving at the drift tube gap 10 to accelerate or decelerate them depending on their time of arrival with respect to the phase of the applied input signal. The resultant bunching of the electron beam is further enhanced by subsequent resonant cavities between the input cavity 2 and the output cavity 7. Three of these intermediate cavities 3, 5 and 6 (known as "buncher cavities") are tuned to a frequency which is slightly higher than the fundamental frequency, typically in the range of 1 to 5% higher, to give what is termed "inductive tuning". The effect is to bring the electrons of the beam spatially closer together to produce tighter bunches and hence increase efficiency at the output cavity 7 from which an output signal is extracted via a coupling loop 11. The output cavity 7 is tuned to the fundamental frequency. In addition to the intermediate cavities tuned to just above the fundamental frequency, the resonant cavity 4 included near the input end of the device is tuned to slightly less than twice the fundamental frequency to provide what is termed "capacitive tuning". The capacitively tuned second harmonic resonant cavity 4 reduces the velocity spread of electrons in the bunches and hence improves efficiency at the output. It divides each electron bunch received from the intermediate cavity 3 into two bunches, each having a more uniform velocity distribution than the larger bunches from the intermediate cavity 3. The following inductively tuned intermediate cavities 5 and 6 act upon the divided bunches received from the second harmonic cavity 4 to bring them closer together, such that they are eventually recombined at the output cavity 7.

The present invention seeks to provide a device having improved efficiency. The invention is particularly applicable to klystrons but may also improve efficiency of other electron beam tubes employing density and/or velocity modulation in which bunching of electrons occurs during operation.

According to a first aspect of the invention, there is provided an electron beam tube of a type wherein an input signal having a fundamental frequency is applied to an electron beam to form electron bunches, the tube comprising: a buncher resonant cavity; a penultimate resonant cavity inductively tuned near a harmonic of the fundamental frequency; and an output resonant cavity from which an output signal is extracted.

Use of the invention enables improved efficiency to be achieved. The penultimate resonant cavity is tuned to give inductive tuning at a harmonic of the fundamental frequency, that is, it is tuned to a frequency which is slightly higher than the harmonic of the fundamental frequency, typically, 5% higher. This reduces the spatial spread of the bunches at the drift tube gap of the output cavity, making the bunches "sharper".

The input signal used to modulate the electron beam to form electron bunches may, for example, be a high frequency CW signal or may be modulated with, for example, a TV or other data signal. Although the invention is particularly applicable to klystrons, it may also be used with advantage in other types of tube in which electron bunching occurs such as for example inductive output tubes (IOTs) and tubes in which both density and velocity modulation of an electron beam takes place.

Preferably, there is included an input resonant cavity at which the input signal is applied. However, in some tubes, the input signal may be applied for example via a coaxial input line to directly modulate a grid located in front of a cathode of the electron beam gun, for example. Where an input cavity is included, preferably it is tuned to the fundamental frequency.

Preferably, the output cavity is tuned to the fundamental frequency. However, the invention may be employed in a frequency multiplier for example, in which case the output cavity may be tuned to a harmonic of the fundamental frequency.

In one advantageous embodiment of the invention, the penultimate resonant cavity is tuned to slightly greater than twice the fundamental frequency. However, the penultimate resonant cavity may be tuned to slightly above the third harmonic, fourth harmonic or other higher multiples of the fundamental frequency. It may be desirable to include one or more cavities immediately before the penultimate cavity each of which is inductively coupled at a harmonic of the fundamental frequency. The harmonic frequencies selected may be the same in each case or may be respective different harmonic frequencies. The harmonic frequency selected may be the same as that of the penultimate resonant cavity frequency.

The electron beam tube may also include a cavity tuned to slightly less than a harmonic frequency of the fundamental frequency to give capacitive tuning and hence reduce velocity spread of electrons in the bunches. Such a cavity is preferably located near the high frequency input of the tube.

In a particularly advantageous embodiment of the invention, the penultimate cavity includes a drift tube gap which is located at the position where an output cavity drift tube gap would be located if the penultimate cavity were not included in the tube. This geometry is particularly advantageous, giving good efficiency at the output cavity. In one preferred embodiment, the penultimate cavity is partially extensive within the volume defined by the output cavity. The penultimate and output cavities may have a common wall. In one preferred arrangement the penultimate cavity includes a conical wall extensive within the output cavity.

According to a second aspect of the invention, there is provided an electron beam tube of a type wherein a plurality of electron bunches are formed, the tube comprising: an output resonant cavity from which an output signal is extracted; and a penultimate resonant cavity inductively tuned near a harmonic of the fundamental frequency, the penultimate cavity being partially extensive within the output cavity.

Figure 2:
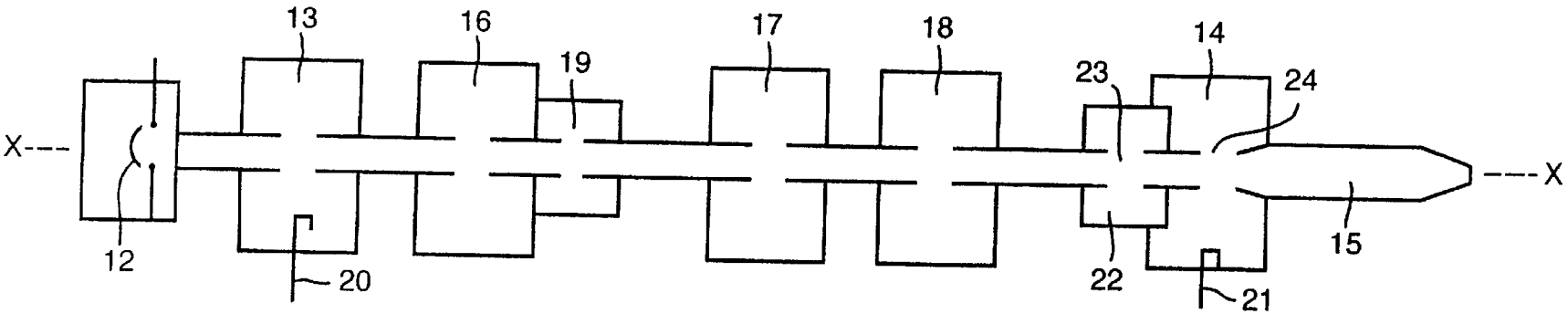
Figure 3:
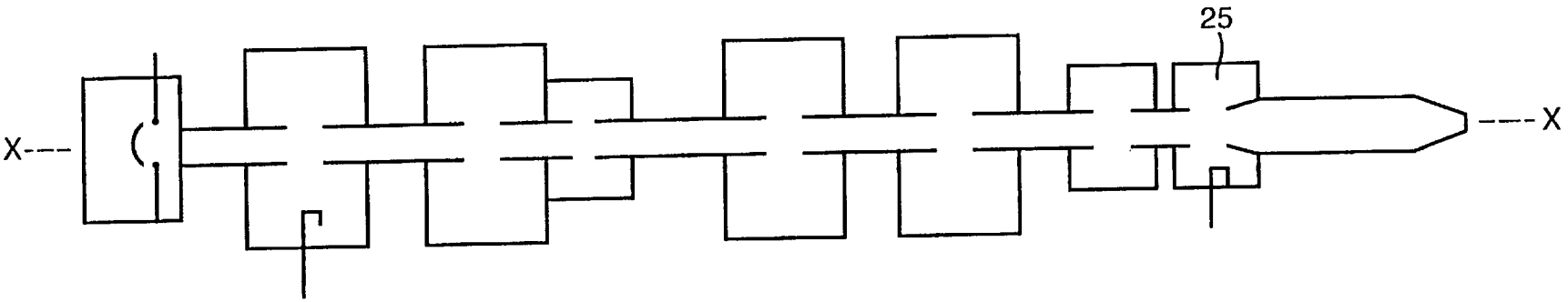
Figure 4:
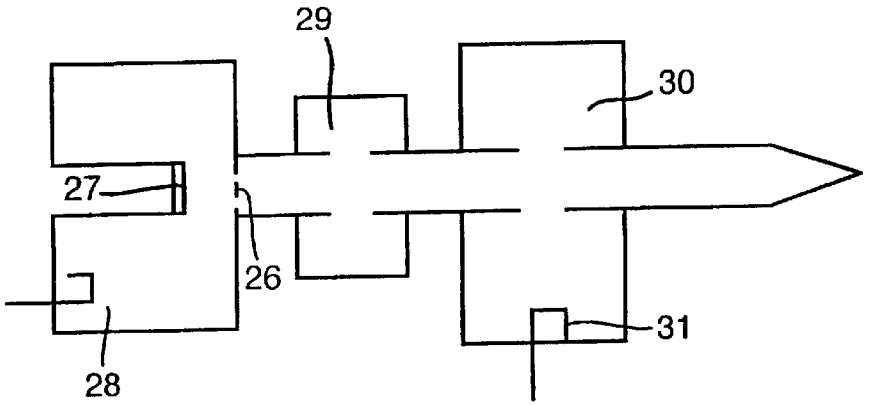
Figure 5:
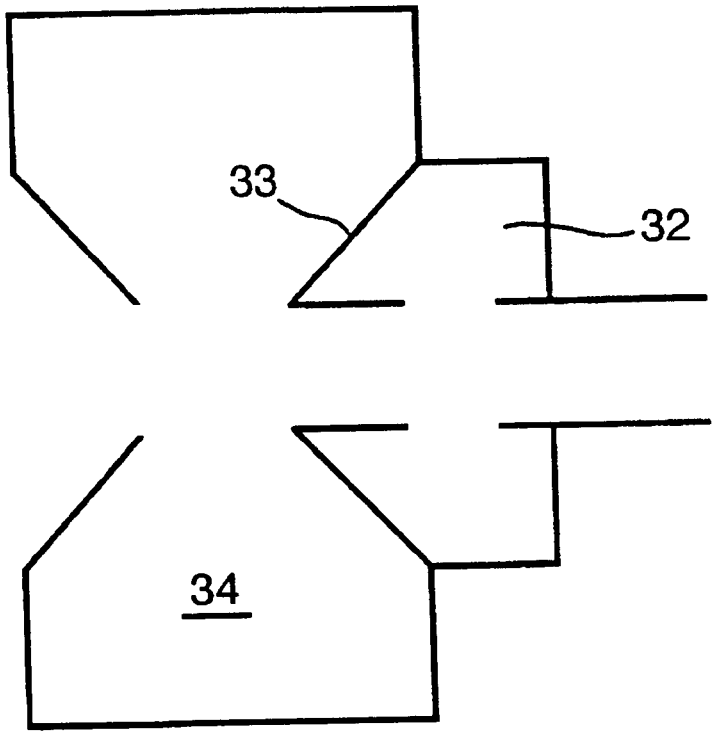

Some ways in which the invention may be performed are now described by way of example with reference to the accompanying drawings, in which:

FIG. 1 schematicall illustrates a prior art Klystron;

FIG. 2 schematically illustrates a klystron in accordance with the invention;

FIG. 3 schematically illustrates a frequency multiplier in accordance with the invention;

FIG. 4 schematically illustrates an IOT in accordance with the invention; and FIG. 5 schematically shows an arrangement of penultimate and output cavities.

With reference to FIG. 2, a klystron in accordance with the invention is similar in many respects to the known arrangement illustrated in FIG. 1. It includes an electron gun 12, an input cavity 13 and an output cavity 14 which are resonant at the fundamental frequency of the tube, and a collector 15. Three intermediate cavities 16, 17 and 18 tuned to slightly greater than the fundamental frequency are located between the input cavity 13 and the output cavity 14 to give inductive tuning. A second harmonic resonant cavity 19 is located between the first two inductively tuned intermediate cavities 16 and 17 and is capacitively tuned to the electron beam being resonant at a frequency which is slightly less than twice the fundamental frequency. Coupling means 20 is included in the input cavity for applying a modulating input signal to the input cavity and an output loop 21 is used to extract energy from the output cavity 14.

The penultimate cavity 22 before the output cavity 14 is resonant at a frequency slightly greater than two times the fundamental frequency, whereby providing inductive tuning at the second harmonic frequency. The drift tube gap 23 of the penultimate cavity 22 is located at the same position as would be occupied by the output gap of a tube if the penultimate cavity were to be omitted. The penultimate cavity 22 partially extends within the volume defined by the output cavity 14.

Each bunch at the plane of the penultimate cavity gap 23 is substantially contained within less than one half cycle of the fundamental frequency. The effect of the penultimate cavity 22 is to sharpen the electron bunches arriving from the previous inductively tuned fundamental frequency cavity 18, reducing the spatial spread of electron bunches and increasing their electron density. This additional compression of the bunches leads to an improvement in the conversion efficiency of the klystron. The drift tube gap 23 in the penultimate cavity 22 is located relatively closely to the drift tube gap 24 in the output cavity 14 so that the bunches remain tight at this point. If the drift tube gap 24 were moved down-stream, de-bunching would tend to occur before the energy could be extracted at 21.

In other embodiments of the invention, the capacitively tuned harmonic cavity 19 might be omitted and fewer or more intermediate cavities could be included. In other arrangements, the penultimate cavity might be tuned to give inductive tuning at other harmonics of the fundamental frequency. In other embodiments, one or more inductively tuned harmonic cavities may be included before the penultimate cavity to give increased sharpening of the electron bunches.

With reference to FIG. 3, another klystron in accordance with the invention is arranged to operate at a frequency multiplier in which the input signal at the fundamental frequency is doubled. The components are similar to those shown in FIG. 2 but in this case the output cavity 25 is resonant at two times the fundamental frequency, enabling energy to be efficiently extracted at twice the input frequency.

FIG. 4 illustrates an inductive output tube in accordance with the invention. In this arrangement, a grid 26 is located in front of the cathode 27 of the electron gun. A modulating high frequency signal at a fundamental frequency is applied to the region between the cathode 26 and grid 27 via an input resonant cavity 28 which surrounds the electron gun. Following this input arrangement, a penultimate resonant cavity 29 is tuned to be resonant at slightly greater than two times the fundamental frequency and its output is delivered to an output cavity 30 which is resonant at the fundamental frequency. The output signal is extracted from this cavity 30 via coupling means 31.

FIG. 5 schematically shows part of a klystron in accordance with the invention in which a penultimate resonant cavity 32 is tuned to be resonant at slightly higher than twice the fundamental frequency. The penultimate cavity 32 includes a substantially conical wall 33 which is common with the output cavity 34 and is frusto-conical in shape.

What is claimed is:

1. An electron beam tube wherein an input signal having a fundamental frequency is applied to an electron beam to form electron bunches, said tube comprising; a buncher resonant cavity; an output resonant cavity from which an output signal is extracted; and a penultimate resonant cavity, inductively tuned near a harmonic of the fundamental frequency, and partially extensive within the volume defined by the output cavity.

2. A tube as claimed in claim 1 and including an input resonant cavity at which the input signal is applied.

3. A tube as claimed in claim 2 wherein the input cavity is tuned to the fundamental frequency.

4. A tube as claimed in claim 1 wherein the output cavity is tuned to the fundamental frequency.

5. A tube as claimed in claim 1 wherein the output cavity is tuned to a harmonic of the fundamental frequency.

6. A tube as claimed in claim 1 wherein the penultimate resonant cavity is tuned to a frequency slightly greater than two times the fundamental frequency.

7. A tube as claimed in claim 1 and including one or more cavities immediately before the penultimate cavity, each of which is tuned to a frequency slightly greater than a harmonic of the fundamental frequency.

8. A tube as claimed in claim 1 and including a cavity tuned to a frequency slightly less than a harmonic of the fundamental frequency.

9. A tube as claimed in claim 1 and including a plurality of buncher cavities between an input cavity and the penultimate cavity tuned to a frequency slightly greater than the fundamental frequency.

10. A tubes as claimed in claim 1 wherein the penultimate cavity includes a drift tube gap which is located at the position where an output cavity drift tube gap would be located if the penultimate cavity were not included in the tube.

11. A tube as claimed in claim 1 wherein the penultimate cavity and output cavity have a common wall.

12. A tube as claimed in claim 1 wherein the penultimate cavity includes a substantially conical portion which is extensive into the output cavity.

13. A tube as claimed in claim 1 wherein the electron beam is density modulated.

14. A tube as claimed in claim 1 wherein the electron beam is velocity modulated.

* * * * *